US007306061B2

(12) United States Patent
Lin et al.

(10) Patent No.: US 7,306,061 B2
(45) Date of Patent: Dec. 11, 2007

(54) MUD DIVERTER FOR EARTH-BORING BIT

(75) Inventors: Chih C. Lin, Spring, TX (US); Gregory L. Ricks, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 301 days.

(21) Appl. No.: 11/060,331

(22) Filed: Feb. 17, 2005

(65) Prior Publication Data

US 2005/0178589 A1 Aug. 18, 2005

Related U.S. Application Data

(63) Continuation-in-part of application No. 10/780,389, filed on Feb. 17, 2004, now Pat. No. 7,066,287.

(51) Int. Cl.
*E21B 10/22* (2006.01)

(52) U.S. Cl. ..... 175/371

(58) Field of Classification Search ..... 166/371, 166/313, 372, 331, 356, 359, 340; 384/94
See application file for complete search history.

(56) References Cited

U.S. PATENT DOCUMENTS

| | | | | |
|---|---|---|---|---|
| 2,260,487 | A * | 10/1941 | Scott | 175/340 |
| 2,769,616 | A | 11/1956 | Morlan et al. | |
| 2,960,313 | A | 11/1960 | Goodwin | |
| 4,395,076 | A * | 7/1983 | Sabre | 384/92 |
| 4,515,228 | A | 5/1985 | Dolezal et al. | |
| 4,688,651 | A * | 8/1987 | Dysart | 175/371 |
| 5,056,610 | A | 10/1991 | Oliver et al. | |
| 6,264,367 | B1 * | 7/2001 | Slaughter et al. | 384/94 |

* cited by examiner

*Primary Examiner*—Kenneth Thompson
(74) *Attorney, Agent, or Firm*—Bracewell & Giuliani LLP

(57) ABSTRACT

A rolling cone earth boring bit has a diverter and an arcuate segment located between the bit leg and the back face of the cone to divert debris from the seal gland area. The diverter has an oblong or oval base that inserts into a mating hole in a last machined surface of the bit. The diverter has a head that is wedge-shaped and protrudes from the hole into a clearance between the back face and the last machined surface. The head has an inner side that is spaced from an annular wall of the back face by a small uniform clearance. The head has an outer side that is oblique to the annular wall of the back face region to divert debris from the clearance. The segment is spaced from the diverter and is concentric to an axis of the bearing pin.

19 Claims, 4 Drawing Sheets

Fig. 4
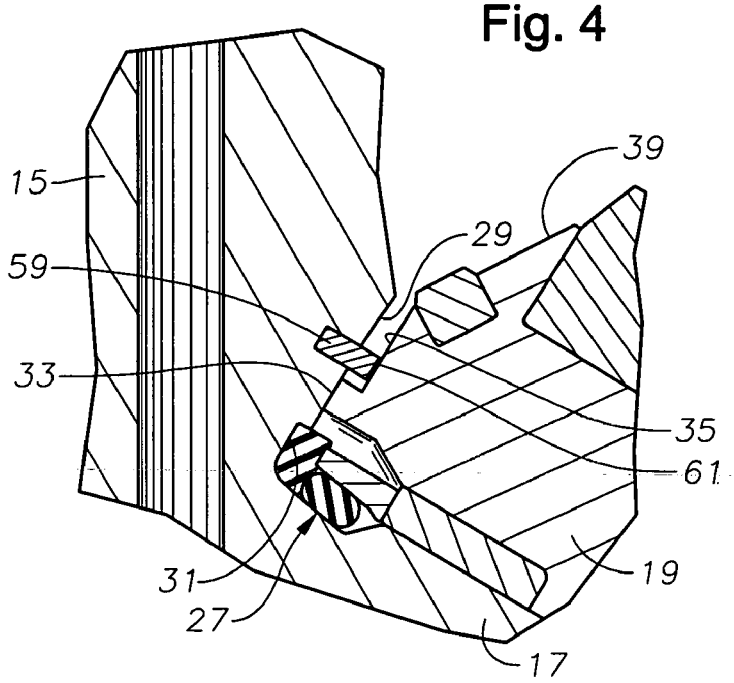
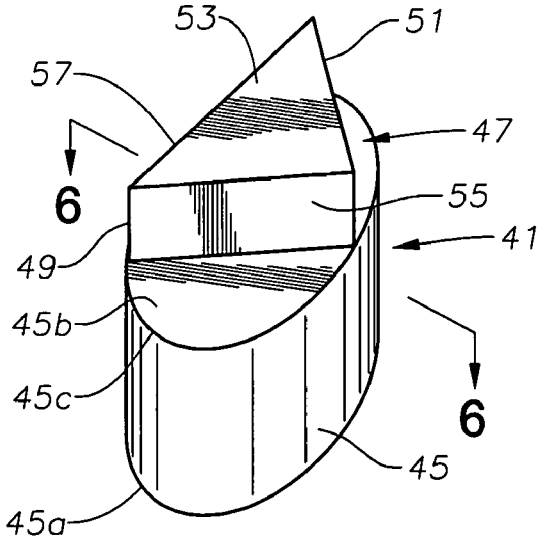
Fig. 5
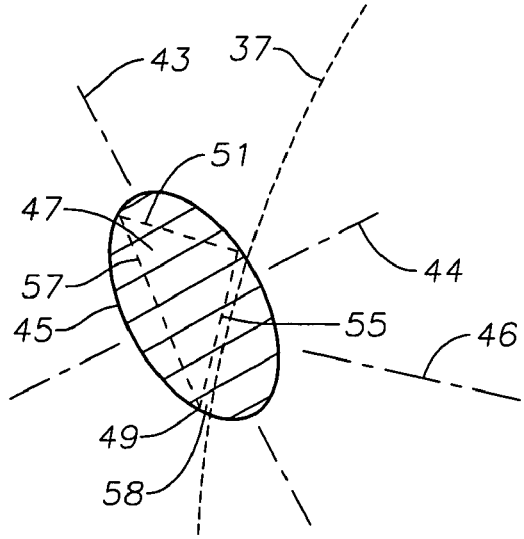
Fig. 6

MUD DIVERTER FOR EARTH-BORING BIT

CROSS REFERENCE TO RELATED APPLICATION

This application is a continuation-in-part of application Ser. No. 10/780,389, filed Feb. 17, 2004, U.S. Pat. No. 7,066,287.

FIELD OF THE INVENTION

This invention relates in general to earth boring bits, and in particular to a diverter located between the bit leg and the back face for diverting debris from the seal area of the cone.

BACKGROUND OF THE INVENTION

A typical rolling cone earth boring bit has a bit body with three legs. Each bit leg has a bearing pin that extends downward and inward. A cone mounts on the bearing pin, the cone having a back face that is closely spaced to a last machined surface on the bit leg. A seal located in a seal gland near the last machined surface seals lubricant within the bearing spaces between the cone and the bearing pin.

While drilling, cuttings and other debris flow around the bit. In some cases, the cuttings tend to migrate into the clearance between the back face and the last machined surface. The debris enters the seal area, resulting in wear to the seal and possibly premature bearing failure.

In the prior art, deflecting pins have been mounted in holes in the last machined surfaces. These pins are closely spaced to the back face of the cone for retarding entry of debris into the seal gland area. While workable, improvements are desired.

SUMMARY OF THE INVENTION

In the preferred embodiment of this invention, at least one diverter is mounted in a hole in the bit leg, the diverter having a protruding head that is located adjacent to the back face region. The head is generally wedge-shaped, with a more pointed end facing into the direction of rotation of the cone. The diverter head has an inner side that is generally perpendicular to a radial line emanating from the axis of the bearing pin. The diverter head has an outer side that is at an acute angle relative to the inner side. Preferably, the base of the diverter is oblong or oval shaped.

An arcuate segment is mounted in the bit leg rotationally rearward from the diverter. The segment is a curved band that protrudes from the bit leg. Preferably, the arcuate segment is concentric with the bearing pin axis, extends less than 180 degrees and is located above the bearing pin.

The back face region of the cone has inner and outer portions that are flat and perpendicular to the axis of the bearing pin. An annular wall separates the inner and outer portions. The outer portion is spaced by a larger clearance from the last machined surface than the inner portion. The head of the diverter locates in the larger clearance with the inner side of the head closely spaced to the annular wall. The inner side is shaped to substantially follow the contour of the annular wall in a preferred embodiment. The segment also locates in the larger clearance area and is closely spaced to the annular wall.

BRIEF DESCRIPTION OF THE DRAWINGS

FIG. 4 is an enlarged sectional view of the bit of FIG. 1, taken along the line 4-4 of FIG. 2.

FIG. 5 is a perspective view of the diverter member of the drill bit of FIG. 1.

FIG. 6 is a transverse sectional view of the diverter member of FIG. 5, taken along the line 6-6 of FIG. 5.

DETAILED DESCRIPTION OF THE INVENTION

Figure 1:
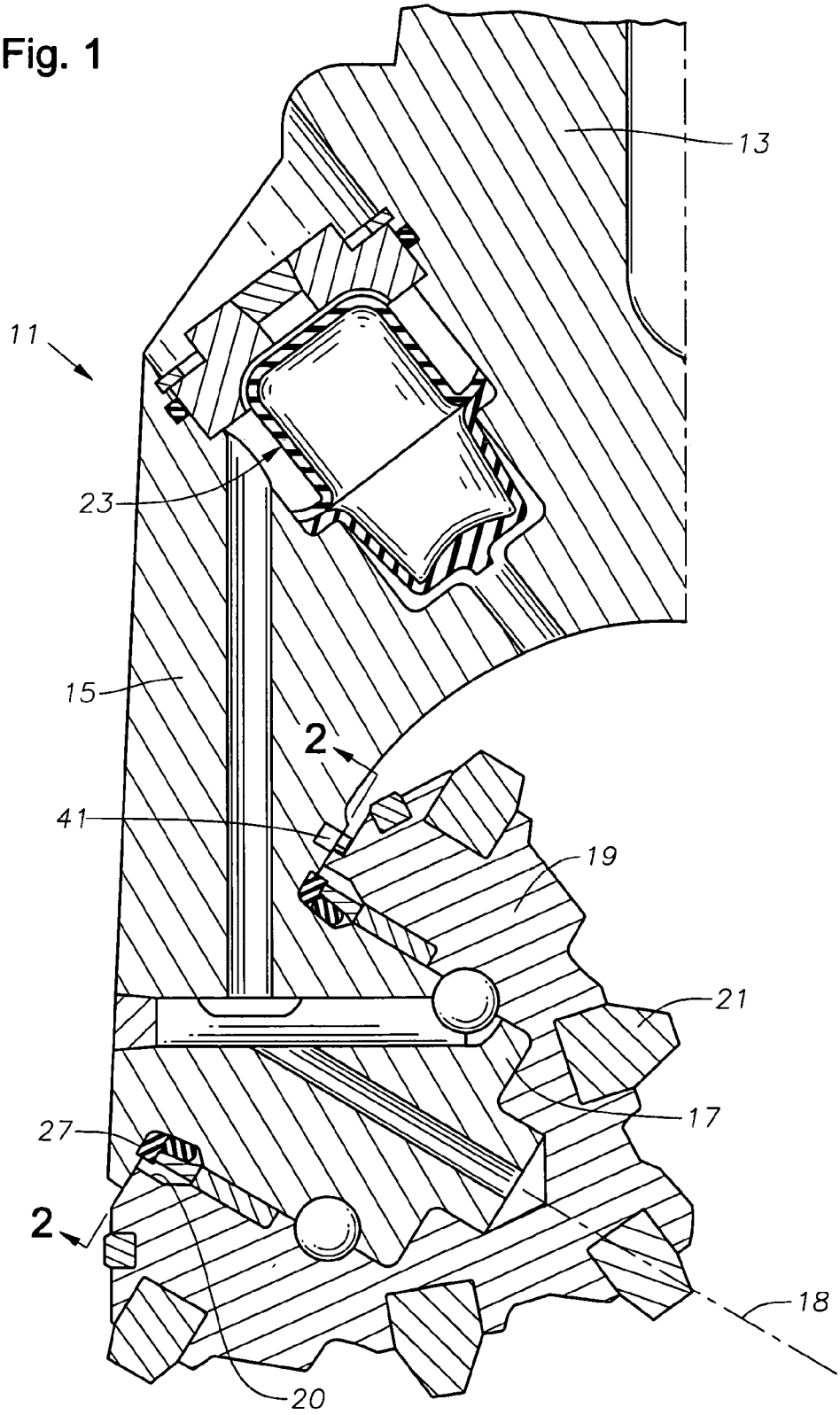
FIG. 1 is a vertical sectional view of a portion of a drill bit constructed in accordance with this invention.

Referring to FIG. 1, bit 11 has a body 13 with at least one bit leg 15. Typically, there are three of the bit legs 15. Each bit leg 15 has a bearing pin 17 that extends downward along a bearing pin axis 18 toward an axis of rotation of body 13. A cone 19 with a central cavity 20 mounts rotatably on bearing pin 17, which has a journal bearing surface. Cone 19 has a plurality of cutting elements 21. Cuttings elements 21 may be either hard metal inserts inserted into mating holes as shown, or milled teeth formed on the exterior of cone 19.

Each leg 15 has a pressure compensator 23 and lubricant passages that lead to the journal bearing surfaces between cone 19 and bearing pin 17. Pressure compensator 23 reduces pressure differential between the hydrostatic pressure of the drilling fluid in the well and the pressure of the lubricant in lubricant passages and clearances around bearing pin 17. An annular seal assembly 27 is located at the base of bearing pin 17 for sealing the lubricant within the journal bearing. As shown, seal assembly 27 comprises two metal face seal rings, an elastomer energizer, and an elastomeric backup ring, however, seal assembly 27 could be of many different types.

Figure 2:
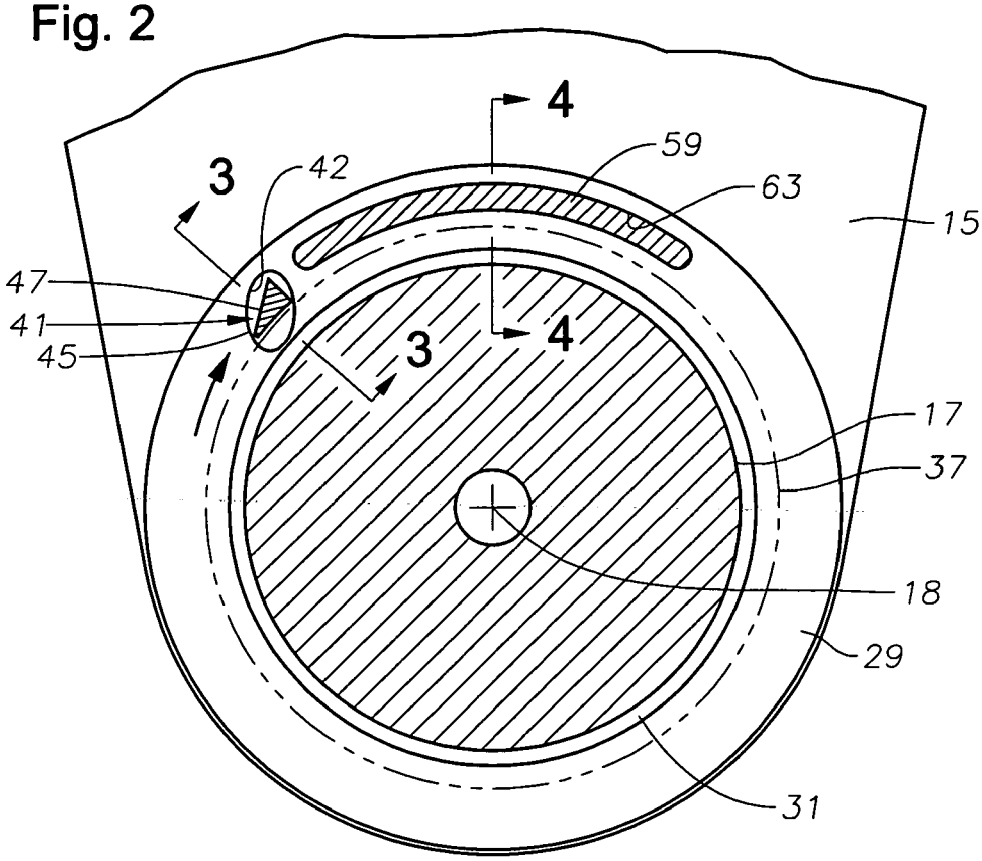
FIG. 2 is an enlarged sectional view of the bit of FIG. 1, taken along the line 2-2 of FIG. 1.

Referring to FIG. 2, seal assembly 27 is located within an annular seal cavity or gland 31 that is partially on bearing pin 17 and partially on bit leg 15. A last machined surface 29 on bit leg 15 borders seal gland 31 and extends radially outward therefrom relative to bearing pin axis 18 (FIG. 1). Last machined surface 29 is a flat surface located in a plane perpendicular to axis 18 (FIG. 1) of bearing pin 17.

Figure 3:
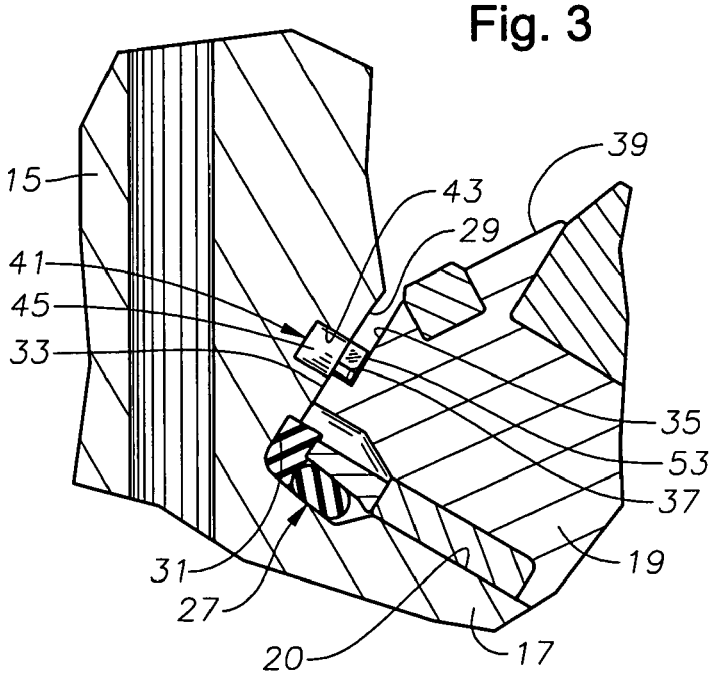
FIG. 3 is an enlarged sectional view of the bit of FIG. 1, taken along the line 3-3 of FIG. 2.

Referring to FIG. 3, in this embodiment, cone 19 has a flat inner back face portion 33 beginning at seal gland 31 and extending outward perpendicular to axis 18 of bearing pin 17. An outer back face portion 35 joins inner back face portion 33. Outer back face portion 35 is also flat and perpendicular to axis 18 (FIG. 1) of bearing pin 17, however it is spaced axially from inner back face portion 33, relative to axis 18. An annular wall 37 is located at the junction of inner back face portion 33 with outer back face portion 35, wall 37 preferably being cylindrical. Alternately, wall 37 could be conical or tapered. The clearance between inner back face portion 33 and last machined surface 29 is smaller than the clearance between outer back face portion 35 and last machined surface 29. In this embodiment, outer back face portion 35 extends outward to a gage surface 39. Gage surface 39 is a conical surface that governs the outer diameter of the hole being drilled.

At least one, and optionally a plurality of diverters 41 are mounted to last machined surface 29. Diverter 41 has a base 45 that is interferingly pressed into a mating hole 42 formed in last machined surface 29. Referring to FIGS. 5 and 6, base 45 has a flat bottom 45*a*, a flat top 45*b*, and a noncylindrical side wall 45*c*, which is preferably generally oval when viewed in transverse cross-section, as shown in FIG. 6. The term "oval" is meant herein to include oblong, elliptical side walls 45*c*, and other shapes that have a long dimension greater than a width dimension. Side wall 45*c* in this example is elliptical, having a major axis 43 and a minor axis 45. Also, in this example, neither axis 43 nor axis 44 is coincident with a radial line 46 emanating from bearing pin axis 18 (FIG. 1). Rather, both axes 43, 44 are angled about 45 degrees in this example relative to radial line 46. Base top surface 45*b* is substantially flush with last machined surface 29. Hole 42 is located so that part of diverter base 45 is located in the smaller clearance area between last machined surface 29 and inner back face portion 33 (FIG. 3). The innermost portion of diverter base 45 is closer to bearing pin axis 18 (FIG. 1) than annular wall 37. The outermost portion of diverter base 45 is in a part of the larger clearance between last machined surface 29 and outer back face portion 35.

A head 47 integrally formed on the top of base 45 protrudes into the clearance between last machined surfaced 29 and outer back face portion 35. As shown also in FIG. 5, head 47 is wedge or triangular-shaped in a transverse cross-section perpendicular to an axis of base 45. Head 47 has a leading side 49 that forms a point or sharper end of head 47, and a trailing side 51 that is 180 degrees from leading side 49. Leading side 49 points into the direction of rotation of cone 19, as indicated by arrow 53 in FIG. 2. Leading side 49 need not be a sharp point, but it is considerably narrower than trailing side 51. Leading side 49 and trailing side 51 may be straight or rounded. Head 47 has a flat top 53 that is closely spaced to inner back face portion 33, as shown in FIG. 3. The dotted lines in FIG. 6 superimpose head 47 on base 45. The distance from leading side 49 to trailing side 51 is greater than the width of base 45 measured along minor axis 44 but less than the width measure along major axis 43.

Head 47 also has an inner side 55 and an outer side 57, which may be straight, as shown, or curved. Inner side 55 is located next to back face annular wall 37. Inner side 55 is generally normal to or perpendicular to radial line 46, as shown in FIG. 6, thus is approximately tangent to annular wall 37. Inner side 55 and outer side 57 diverge from each other at an angle that is preferably in the range from about 30 to 45 degrees. Rather than straight, inner and outer sides 55, 57 could be slightly concave. Outer side 57 could also be slightly convex. The corner formed by inner side 55 and trailing side 51 is shown as a right angle, but it could differ. Because of the orientation of base 45 in this example, neither inner side 55 nor outer side 57 is parallel with either base axis 43, 44.

Making inner side 55 parallel to a portion of back face annular wall 37 results in a substantially uniform width clearance 58 (FIG. 6) between diverter head inner side 55 and back face annular wall 37. Clearance 58 extends from leading side 49 to trailing side 51. Diverter 41 is preferably formed of a carbide material, such as tungsten carbide.

Referring to FIG. 2, an arcuate segment 59 is located rotationally rearward from diverter 41. Segment 59 is a thin, partially circular member that preferably has a radius of curvature about bearing pin axis 18. Segment 59 has a flat top 61 (FIG. 4) that is closely spaced to outer back face portion 35. Segment 59 has an inner diameter that is spaced slightly outward from annular wall 37, creating a uniform clearance. Segment 59 is rectangular in transverse cross-section, as shown in FIG. 4, and is secured in a mating groove 63, such as by soldering or welding. Groove 63 is located in last machined surface 29.

Preferably, segment 59 extends less than 180 degrees, and in the example shown, extends about 120 degrees. The leading end of segment 59 does not need to touch diverter 41, but it is spaced sufficiently close to retard the re-entry of debris that has been diverted outward by diverter 41. In the preferred embodiment, only a single segment 59 is employed, and it is located on the upper side of last machined surface 29, above bearing pin 17. Segment 59 is also preferably formed of a hard, wear resistant material such as tungsten carbide.

In operation, cone 19 (FIG. 1) rotates in the direction indicated by the arrow in FIG. 2 during normal drilling operations. Debris flows in the larger clearance between last machined surface 29 and back face portion 35 (FIG. 3). This debris tends to rotate with cone 19. When the debris contacts diverter head 47, outer side 57 diverts the debris away from back face annular wall 37 and thus away from the area of seal gland 31 (FIG. 3). Segment 59 serves to keep the debris from moving back inward into contact with annular wall 37.

FIGS. 7-10 show alternate embodiments of diverter 41. In these embodiments, base 65 has a side wall that is oval, resembling a race track. The side wall of base 65 has an inner flat side 67 and an outer flat side 68 that are parallel to one another. The leading and trailing ends 69, 70 are arcuate and identical to each other. Head 71 is wedge-shaped, having a flat inner side 73 and a flat outer side 75. Head 71 has a leading end 77 that is smaller in width than its trailing end 79. In this embodiment, both head ends 77, 79 are rounded, and trailing end 79 is co-extensive with the contour of base railing end 70. Leading end 77 extends to base leading end 69. In each of the embodiments of FIGS. 7-10, head inner side 73 is generally parallel to a line that would be tangent to cone annular wall 37, illustrated schematically. Inner side 73 is closely spaced to annular wall 37 and defines a substantially uniform clearance between inner side 73 and annular wall 37. Neither side 73, 75 of head 71 is parallel to major axis 81 in any of the embodiments.

Figure 7:
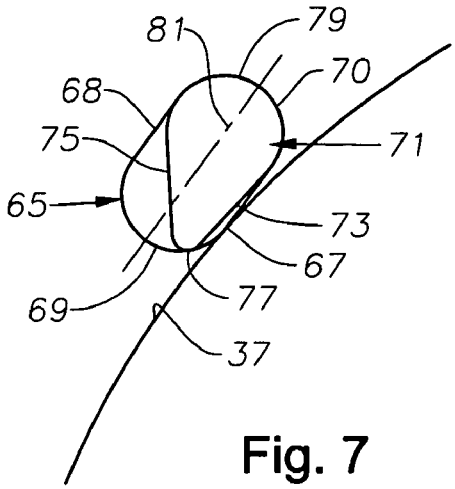
FIG. 7 is a top view of an alternate embodiment of a diverter member.

In the embodiment of FIG. 7, leading end 77 is located between base major axis 81 and annular wall 37. Also, in this embodiment, no portion of base 65 is any closer to the bearing pin axis 18 (FIGS. 1, 2) than annular wall 37.

Figure 8:
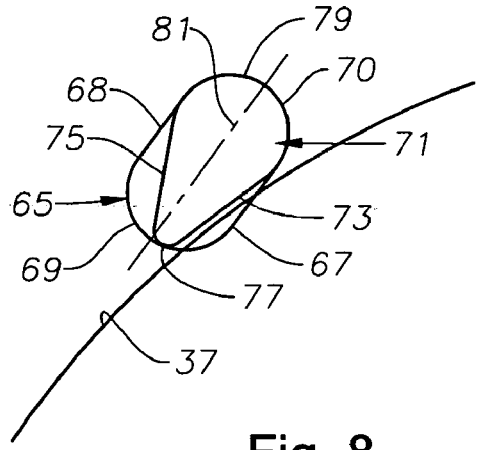
FIG. 8 is a top view of another alternate embodiment of a diverter member.

In the embodiment of FIG. 8, an inner and leading portion of base 65 is located closer to bearing pin axis 18 (FIGS. 1, 2) than annular wall 37. Head 77 has a different orientation from base 65 than in FIG. 7. In FIG. 8, head leading end 77 is closer to major axis 79 than in FIG. 7.

Figure 9:
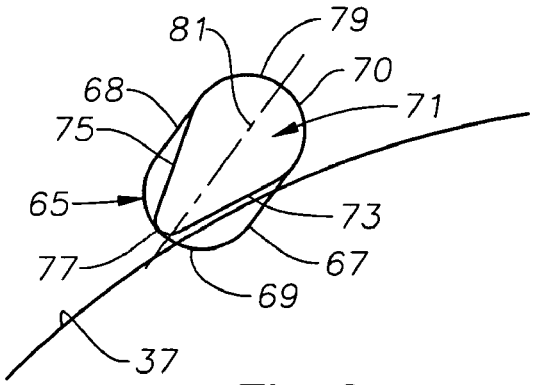
FIG. 9 is a top view of another alternate embodiment of a diverter member.

In the embodiment of FIG. 9, part of the inner and leading side of base 65 is located closer to bearing pin axis 18 (FIGS. 1, 2) than annular wall 37. Head leading end 77 is located between major axis 81 and base outer side 68.

Figure 10:
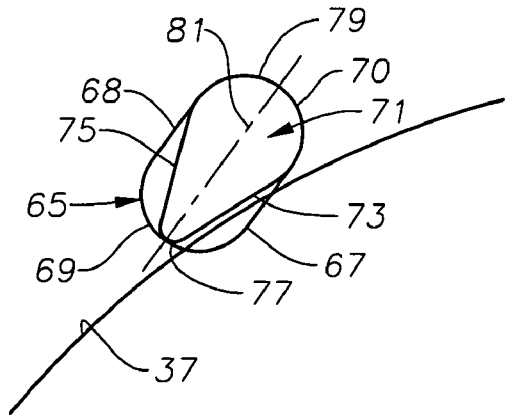
FIG. 10 is a top view of another alternate embodiment of a diverter member.

In FIG. 10, a portion of the inner and leading side of base 65 is closer to bearing pin axis 18 (FIGS. 1, 2) than annular wall 37. Major axis 81 extends through the center of head leading end 77.

The invention has significant advantages. The wedge-shaped diverter head deflects drilling cuttings and debris away from the seal gland area. The narrow clearance between the inner side of the diverter head and the annular wall avoids a nip area that could otherwise draw debris between the head and the annular wall. The oval side wall of the diverter provides and retains orientation for the sides of the diverter head. Furthermore, because the radial width of the hole for the base is limited by the radial width of the last machine surface and the seal gland, an oblong, oval or elliptical hole allows a larger head to be utilized than a cylindrical hole. The trailing segment retards the re-entry of debris diverted by the diverter head.

While the invention has been shown in only one of its forms, it should be apparent to those skilled in the art that it is not so limited but is susceptible to various changes without departing from the scope of the invention. For example, a wedge shaped head could be formed on the leading end of the segment for diverting debris rather than employing a separate diverter member. Also, rather than a single continuous segment, a number of closely spaced diverter members could be employed.

The invention claimed is:

1. An earth boring drill bit, comprising:

a body having at least one leg with a bearing pin depending therefrom;

a cone rotatably mounted on the bearing pin, the cone having a back face closely spaced to the bit leg;

an arcuate segment protruding from a portion of the bit leg in close proximity to the back face to retard entry of debris;

the back face has an inner portion and an outer portion separated by an annular wall that faces outward relative to an axis of the bearing pin; and the segment is closely spaced to and radially outward from the annular wall.

2. The drill bit according to claim 1, wherein the segment has a radius of curvature with a center point coinciding with an axis of the bearing pin.

3. The drill bit according to claim 1, wherein the segment has a base portion that is secured within a mating groove in the bit leg.

4. The drill bit according to claim 1, wherein the segment is located in an upper portion of an annular surface surrounding the bearing pin.

5. An earth boring drill bit, comprising:

a body having at least one leg with a bearing pin depending therefrom;

a cone rotatably mounted on the bearing pin, the cone having a back face closely spaced to the bit leg;

an arcuate segment protruding from a portion of the bit leg in close proximity to the back face to retard entry of debris; and a wedge-shaped surface in close proximity to the back face for diverting debris outward of the segment.

6. The drill bit according to claim 5, wherein the diverter is mounted to the bit leg forward of the segment, considering a direction of rotation of the cone and the wedge-shaped surface faces into the direction of rotation.

7. The drill bit according to claim 5, wherein the diverter is forward of the segment, considering a direction of rotation of the cone, and the diverter comprises:

a base mounted in a mating hole in the bit leg, the base and the hole being generally oval in transverse cross-section; and the wedge-shaped surface comprises a head on the base protruding from the bit leg, the head facing into the direction of rotation and closely spaced to a portion of the back face.

8. The drill bit according to claim 7, wherein the base has a flat end flush with the bit leg, and wherein the head protrudes from the flat end of the base.

9. An earth boring drill bit, comprising:

a body having at least one leg with a bearing pin depending therefrom, the bearing pin having an axis;

an annular flat machined surface formed on an inside surface of the bit leg surrounding the bearing pin;

a cone rotatably mounted on the bearing pin, the cone having a flat inner back face portion and a flat outer back face portion, the inner back face portion being closer to the axis of the bearing pin than the outer back face portion, the outer back face portion spaced farther from the machined surface than the inner back face portion, a junction between the inner and outer back face portions defining an annular wall;

an arcuate segment protruding from a portion of the machined surface, the segment being concentric relative to the axis of the bearing pin radially outward from and in close proximity to the annular wall; and a diverter having a generally wedge-shaped head alongside the annular wall, the diverter being spaced circumferentially forward of the segment, considering the direction of rotation.

10. The drill bit according to claim 9, wherein the segment is rectangular in a transverse cross-section.

11. The drill bit according to claim 9, wherein the segment has a base portion that is secured within a mating groove in the machined surface.

12. The drill bit according to claim 9, wherein the segment extends less than 180 degrees and is located in an upper portion of the machined surface.

13. The drill bit according to claim 9, wherein the diverter comprises:

a base mounted in a mating hole in the machined surface; and wherein the hole has a noncircular wall, a portion of the hole being closed to the axis of the bearing pin than the annular wall.

14. The drill bit according to claim 9, wherein the head of the diverter has an inner side and an outer side that diverge from each other.

15. The drill bit according to claim 9, wherein the head of the diverter has an inner side and an outer side, wherein the inner side generally follows a contour of the annular wall, and the outer side is oblique relative to the annular wall.

16. An earth boring drill bit, comprising:

a body having at least one leg with a bearing pin depending therefrom, the bearing pin having an axis;

an annular flat machined surface formed on an inside surface of the bit leg surrounding the bearing pin;

a cone rotatably mounted on the bearing pin, the cone having a flat inner back face portion and a flat outer back face portion, the inner back face portion being closer to the axis of the bearing pin than the outer back face portion, the outer back face portion being spaced farther from the machined surface than the inner back face portion, a junction between the inner and outer back face portions defining an annular wall;

a diverter having a base located within a mating hole formed in the machined surface and a head protruding from the base and machined surface alongside the annular wall; and wherein the base is generally oval in transverse cross-section.

17. The bit according to claim 16, wherein the head has an inner surface and an outer surface relative to a radius of the axis of the bearing pin, and wherein the outer surface diverges outward from the inner surface.

18. The bit according to claim 16, wherein the head is generally wedge-shaped in transverse cross-section.

19. The bit according to claim 16, wherein the head comprises:

an inner surface that is substantially normal to a radius of the axis of the bearing pin;

an outer surface on a side of the head opposite the inner surface, the outer surface flaring outward considering the direction of rotation of the cone; and a flat end closely spaced and in a plane parallel to the outer back face portion.

* * * * *